US009660370B2

(12) United States Patent
Ashibu

(10) Patent No.: US 9,660,370 B2
(45) Date of Patent: May 23, 2017

(54) CONNECTOR

(71) Applicant: JAPAN AVIATION ELECTRONICS INDUSTRY, LIMITED, Shibuya-ku, Tokyo (JP)

(72) Inventor: Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/980,356

(22) Filed: Dec. 28, 2015

(65) Prior Publication Data

US 2016/0218456 A1 Jul. 28, 2016

(30) Foreign Application Priority Data

Jan. 26, 2015 (JP) ..... 2015-012387

(51) Int. Cl.
*H01R 12/88* (2011.01)
*H01R 12/79* (2011.01)
*H01R 12/77* (2011.01)

(52) U.S. Cl.
CPC ..... *H01R 12/88* (2013.01); *H01R 12/79* (2013.01); *H01R 12/774* (2013.01)

(58) Field of Classification Search
USPC ..... 439/260, 660, 495, 350, 329
See application file for complete search history.

(56) References Cited

U.S. PATENT DOCUMENTS 7,467,962 B2 * 12/2008 Sunaga ..... H01R 12/79 439/260
7,530,831 B2 * 5/2009 Nishimatsu ..... H01R 12/79 439/260
7,601,017 B2 * 10/2009 Wang ..... H01R 12/79 439/260
7,677,917 B2 * 3/2010 Hemmi ..... H01R 12/88 439/495
7,845,962 B2 * 12/2010 Chung ..... H01R 12/79 439/260

(Continued)

FOREIGN PATENT DOCUMENTS

JP 2006260802 A 9/2006
JP 2010238512 A 10/2010

(Continued)

*Primary Examiner* — Alexander Gilman
(74) *Attorney, Agent, or Firm* — Holtz, Holtz & Volek PC

(57) ABSTRACT

A connector has a contact, a maintaining member, a housing, a regulating portion and an actuator. A supporting portion and a projecting portion of the contact have shapes same as those of the maintaining member. The housing holds the contact and the maintaining member. A permitting portion of the housing allows the projecting portion of the contact to be moved in an up-down direction. The regulating portion maintains a state where the projecting portion of the maintaining member projects into a receiving portion of the housing in the up-down direction. When the actuator is moved to the close position in a received state, the projecting portion of the contact is pressed against the object. When the actuator is positioned at the close position in the received state, the projecting portion of the maintaining member is positioned in front of an engaged portion of the object.

8 Claims, 9 Drawing Sheets

(56) References Cited

U.S. PATENT DOCUMENTS

| | | | | |
|---|---|---|---|---|
| 8,382,504 | B2 * | 2/2013 | Matoba | H01R 12/88 439/350 |
| 8,641,439 | B2 * | 2/2014 | Tateishi | H01R 12/88 439/260 |
| 8,708,725 | B2 * | 4/2014 | Shimada | H01R 13/641 439/260 |
| 8,936,496 | B2 * | 1/2015 | Takane | H01R 12/79 439/733.1 |
| 9,093,795 | B2 * | 7/2015 | Ashibu | H01R 12/7011 |
| 9,166,332 | B2 * | 10/2015 | Matoba | H01R 13/6275 |
| 9,397,421 | B2 * | 7/2016 | Ozeki | H01R 12/79 |
| 2006/0105622 | A1 * | 5/2006 | Nakano | H01R 12/771 439/495 |
| 2008/0233781 | A1 * | 9/2008 | Matoba | H01R 12/778 439/258 |
| 2010/0029119 | A1 * | 2/2010 | Taketomi | H01R 23/661 439/329 |
| 2014/0057475 | A1 * | 2/2014 | Tohjo | H01R 12/88 439/329 |

FOREIGN PATENT DOCUMENTS

| | | | |
|---|---|---|---|
| JP | 2011023236 | A | 2/2011 |
| JP | 2013073683 | A | 4/2012 |
| JP | 2013257960 | A | 12/2013 |
| JP | 2013258158 | A | 12/2013 |

* cited by examiner

CONNECTOR

CROSS REFERENCE TO RELATED APPLICATIONS

Applicant claims priority under 35 U.S.C. §119 of Japanese Patent Application No. JP2015-012387 filed Jan. 26, 2015.

BACKGROUND OF THE INVENTION

This invention relates to a connector which is connectable with a plate-like or sheet-like object such as a flexible printed circuit (FPC) or a flexible flat cable (FFC).

As shown in FIG. 15, a connector 900 of JP-A-2013-258158 (Patent Document 1) is provided with a structure for preventing an object (FPC) 950 from coming off from the connector 900 when an actuator 910 is positioned at a close position. Specifically, the object 950 is provided with an engaged portion 952. On the other hand, a contact 920 has a supporting portion 922 being elastically deformable and a projecting portion 924 supported by the supporting portion 922. When the actuator 910 is turned to the close position as illustrated, the projecting portion 924 is applied with downward force. At this time, the projecting portion 924 is positioned in front of the engaged portion 952 of the object 950 and, thereby, restricts forward movement of the object 950. Thus, the object 950 is prevented from coming off.

SUMMARY OF THE INVENTION

It is an object of the present invention to provide a connector which is provided with a structure capable of preventing an object from coming off more certainly.

One aspect of the present invention provides a connector which allows a sheet-like or plate-like object to be inserted rearward from a front end of the connector in a front-rear direction. The object has an engaged portion. The connector comprises a contact, a maintaining member, a housing, a regulating portion and an actuator. Each of the contact and the maintaining member has a supporting portion being elastically deformable and a projecting portion supported by the supporting portion. The supporting portion and the projecting portion of the contact have shapes same as the supporting portion and the projecting portion of the maintaining member, respectively. The housing holds the contact and the maintaining member. The housing is provided with a receiving portion, which receives the object when the object is inserted into the connector, and a permitting portion corresponding to the contact. The permitting portion permits elastic deformation and movement of the supporting portion of the contact to allow the projecting portion of the contact to be moved in an up-down direction perpendicular to the front-rear direction. The regulating portion regulates the elastic deformation and the movement of the supporting portion of the maintaining member to maintain a state where the projecting portion of the maintaining member projects into the receiving portion in the up-down direction. The actuator is movable between an open position and a close position. When the actuator is moved from the open position to the close position in a received state where the object is received by the receiving portion in part, the projecting portion of the contact is pressed against the object. When the actuator is positioned at the close position in the received state, the projecting portion of the maintaining member is positioned in front of the engaged portion of the object.

Since the contact and the maintaining member have the same shapes as each other, it is possible to reduce the number of kinds of parts.

Furthermore, since the housing is provided with the permitting portion, the supporting portion of the contact can be elastically deformed and moved, and the projecting portion of the contact can be moved in an up-down direction. On the other hand, since the regulating portion is provided in the connector, the elastic deformation of the maintaining member is suppressed though the maintaining member is essentially elastically deformable. Consequently, movement of the projecting portion in the up-down direction is regulated. Therefore, according to the structure of the present invention, it is possible to prevent the object from coming off more certainly.

An appreciation of the objectives of the present invention and a more complete understanding of its structure may be had by studying the following description of the preferred embodiment and by referring to the accompanying drawings.

Figure 1:
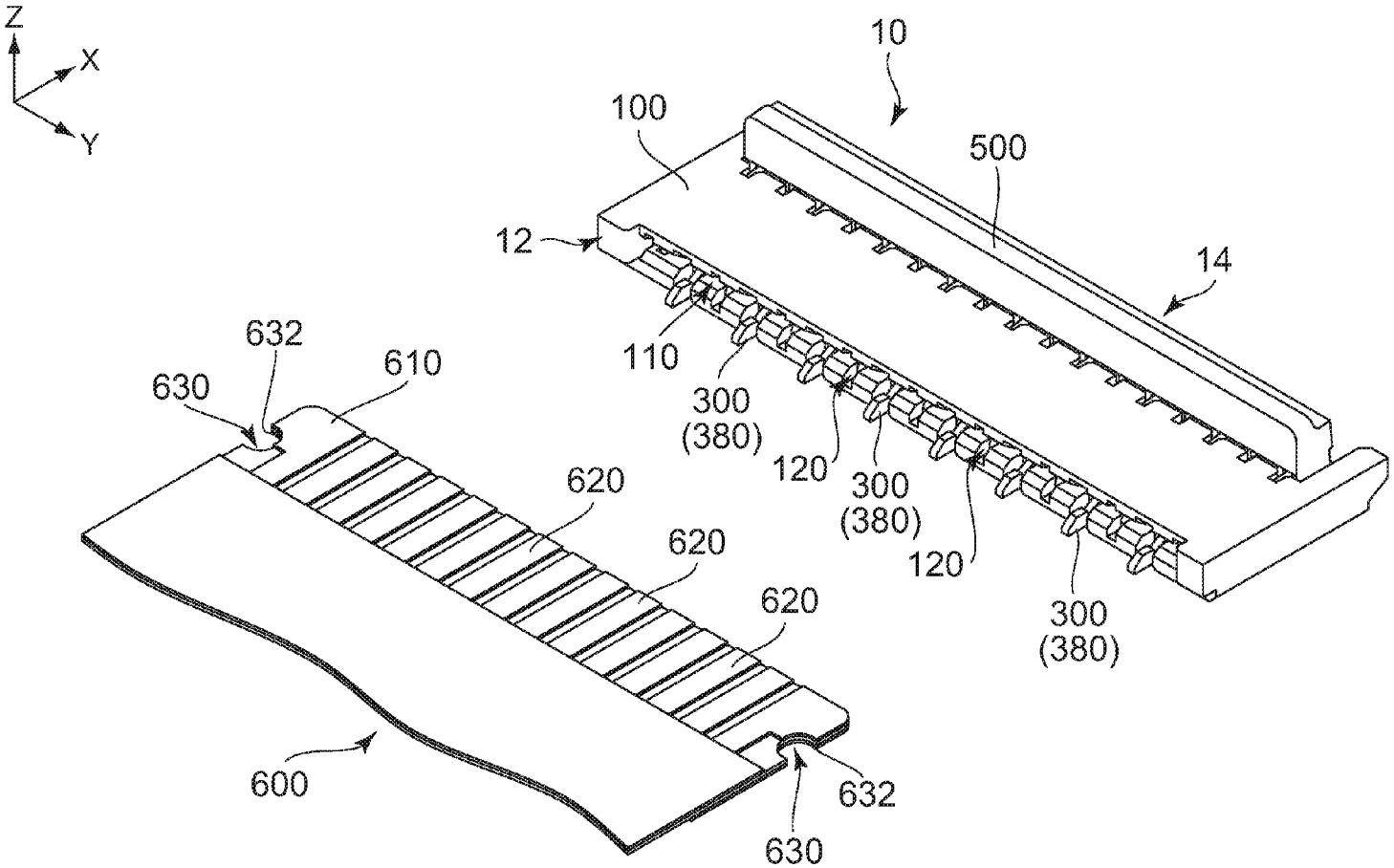
FIG. 1 is a perspective view showing a connector according to a preferred embodiment of the present invention together with an object.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 7:
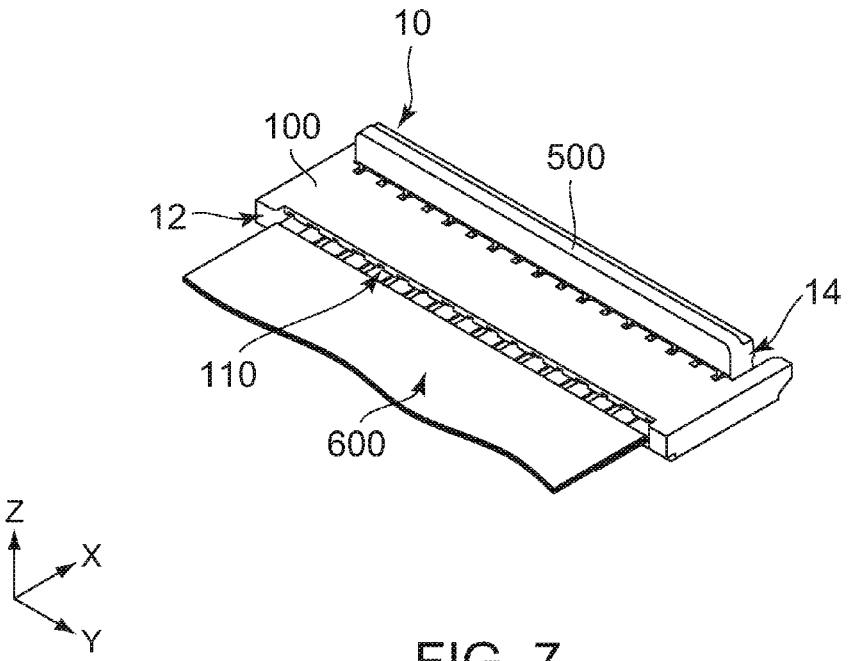
FIG. 7 is a perspective view showing the connector of FIG. 1. Into the illustrated connector, an object is inserted.

Referring to FIGS. 1 and 7, a connector 10 according to a preferred embodiment of the present invention is connectable with an object 600 inserted in the connector 10 along a positive X-direction in an X-direction. Here, the X-direction represents a front-rear direction. Moreover, the positive X-direction is directed rearward while a negative X-direction is directed forward. That is, the connector 10 is connectable with the object 600 inserted toward a rear end 14 of the connector 10 from a front end 12 of the connector 10 in the front-rear direction.

The object 600 of the present embodiment is a flexible printed circuit (FPC). However, the present invention is not limited thereto. For example, the object 600 may be a sheet-like or plate-like object such as a flexible flat cable (FFC).

As shown in FIG. 1, the object 600 has an end portion 610 at which a plurality of terminals 620 are formed. The terminals 620 are aligned in a Y-direction. Here, the Y-direction represents a pitch direction perpendicular to the front-rear direction. In the pitch direction, at both sides of the end portion 610 are formed recess portions 630. Each of the recess portions 630 is recessed inward in the pitch direction. Rear edges of the recess portions 630 serve as engaged portions 632. In other words, the object 600 has engaged portions 632.

Figure 2:
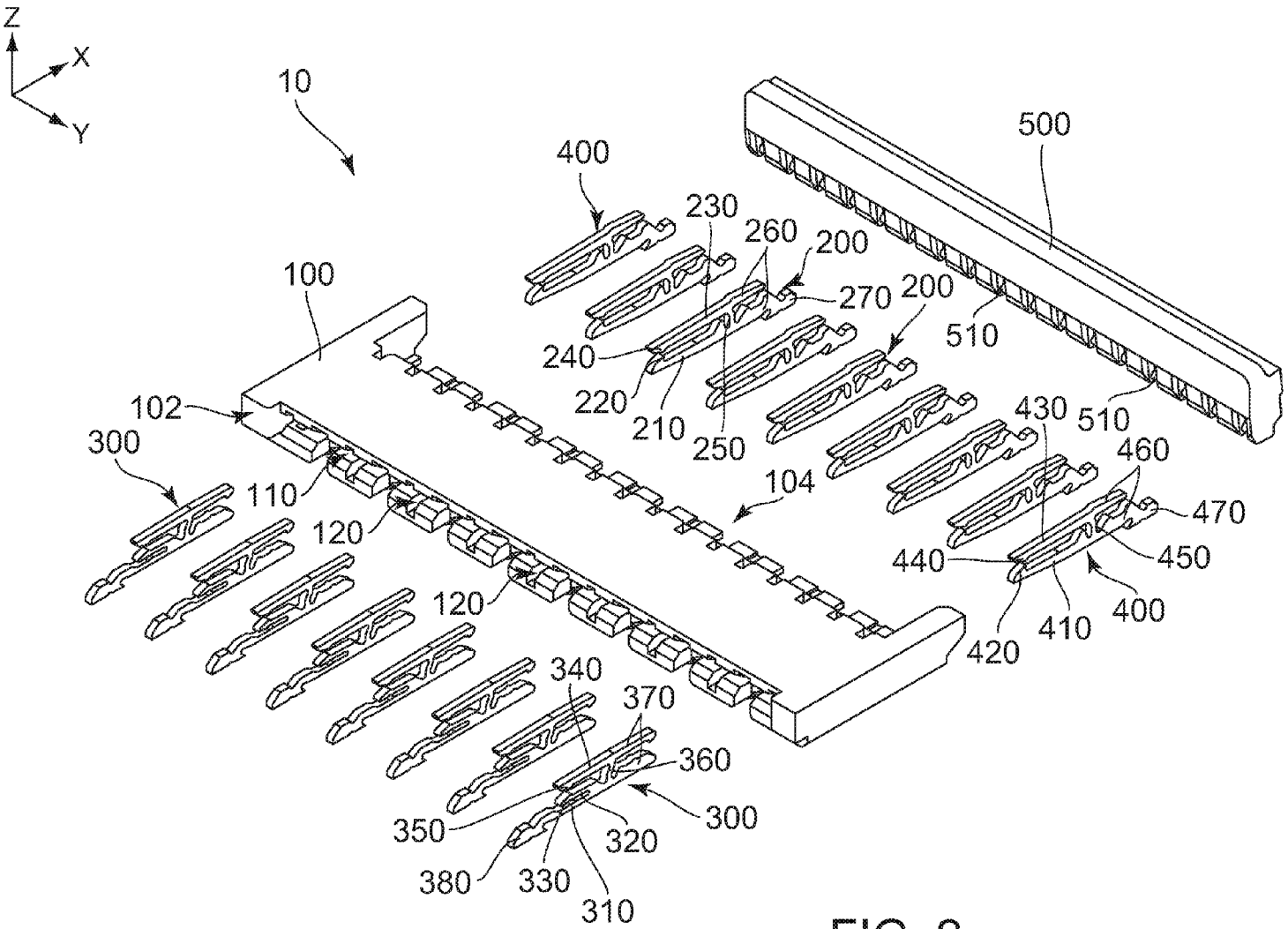
FIG. 2 is an exploded, perspective view showing the connector of FIG. 1.
Figure 3:
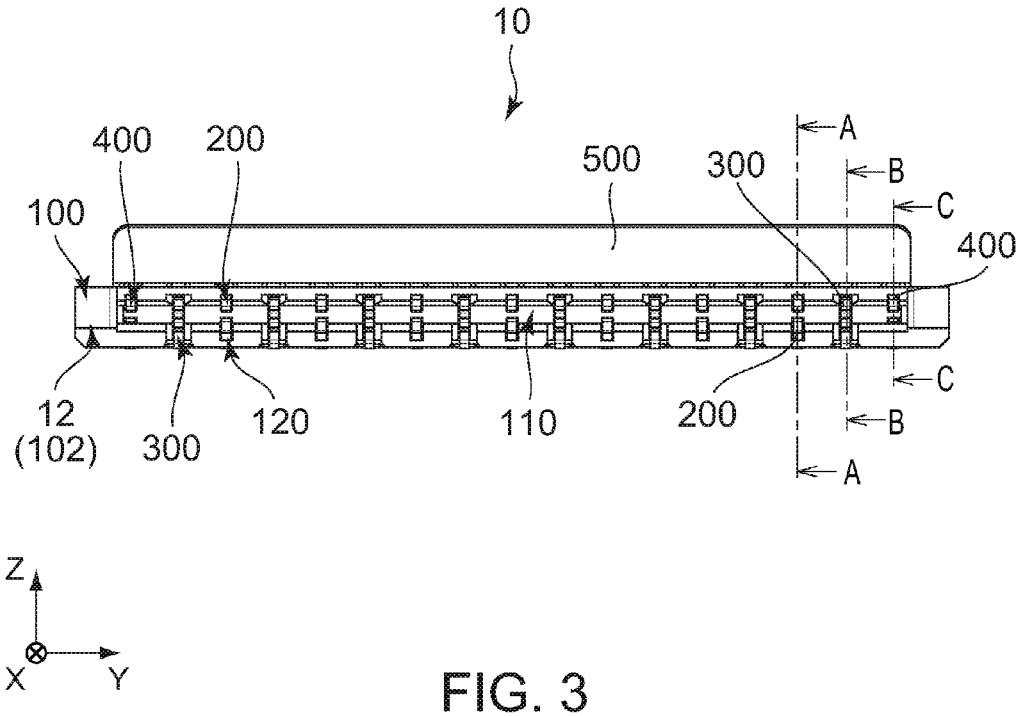
FIG. 3 is a front view of the connector of FIG. 1. An actuator included in the illustrated connector is positioned at an open position. Into the illustrated connector, the object is not inserted.

As best shown in FIG. 2, the connector 10 is provided with a housing 100 made of insulator, first contacts (contacts) 200 made of metal, second contacts 300 made of metal, maintaining members 400 made of metal and an actuator 500 made of insulator.

As shown in FIGS. 2, 4, 8 and 11, the first contact 200 has a first supporting portion (a supporting portion) 210, a first projecting portion (a projecting portion) 220, a first opposed supporting portion (an opposed supporting portion) 230, a first opposed projecting portion (an opposed projecting portion) 240, a first coupling portion 250, a first operated portion 260 and a first fixed portion 270.

Figure 4:
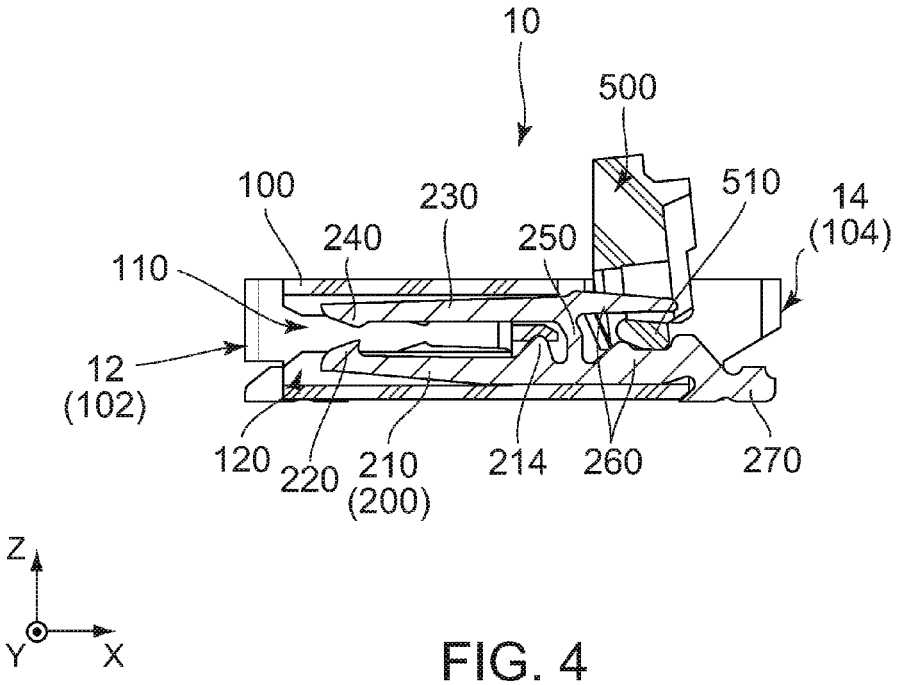
FIG. 4 is a cross-sectional view showing the connector of FIG. 3, taken along A-A line.
Figure 8:
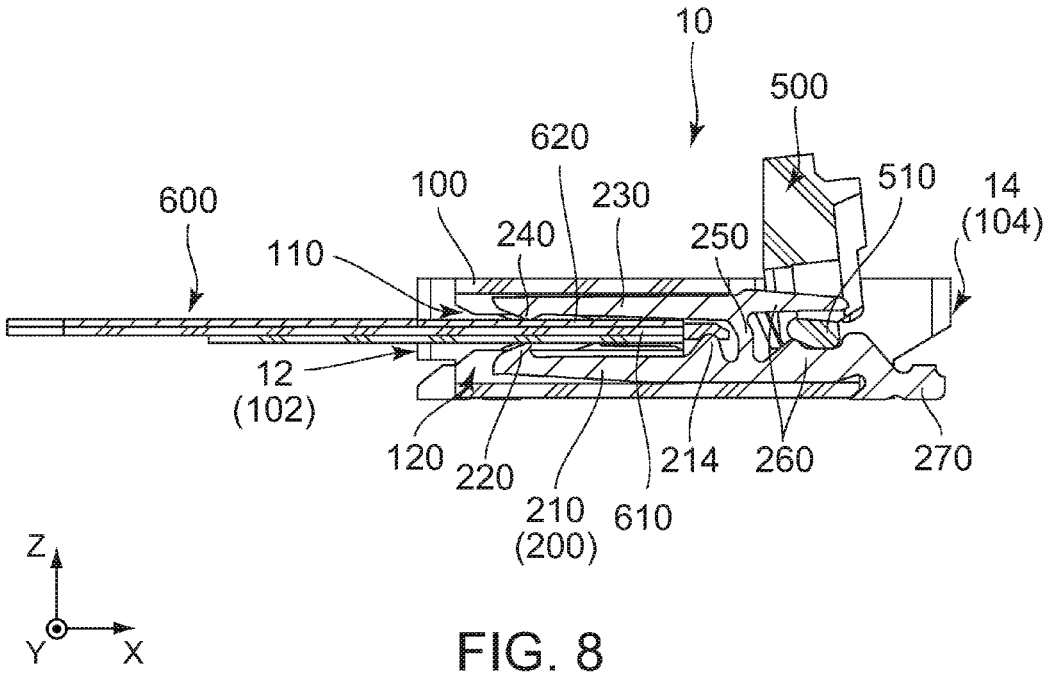
FIG. 8 is a cross-sectional view showing the connector of FIG. 7, wherein illustrated cross-sections correspond to the cross-sections of FIG. 4.
Figure 11:
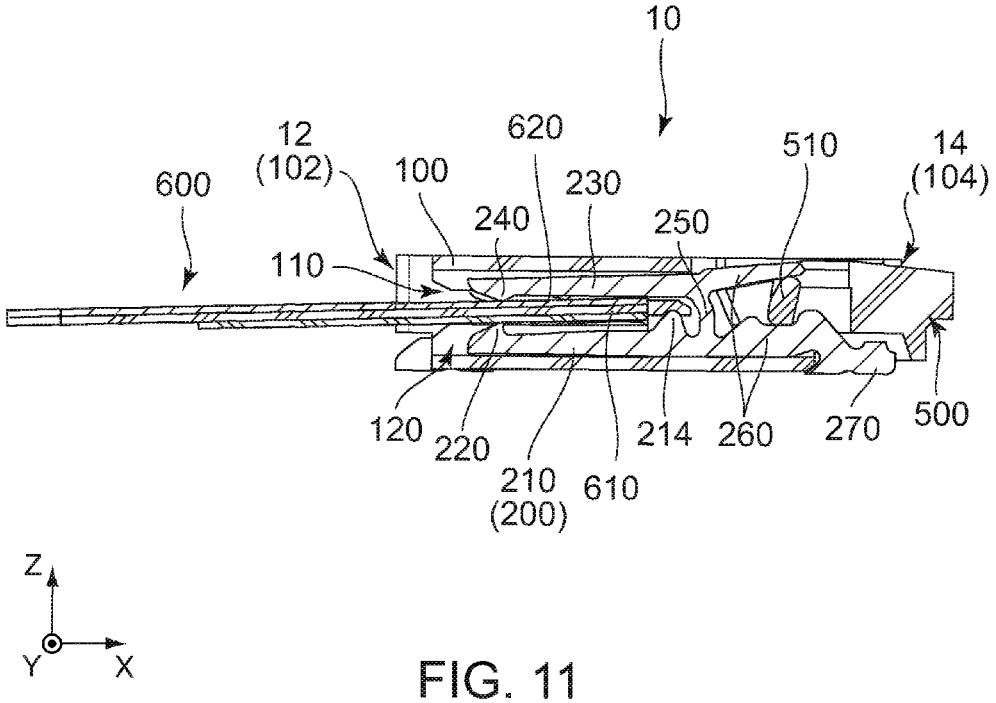
FIG. 11 is a cross-sectional view showing the connector of FIG. 8. The actuator of the illustrated connector is positioned at a close position.

As shown in FIGS. 4, 8 and 11, the first supporting portion 210 mainly extends long in the front-rear direction. The first supporting portion 210 is provided with a first press-fit portion 214. The first supporting portion 210 is elastically deformable and supports the first projecting portion 220. Owing to elastic deformation and movement of the first supporting portion 210, the first projecting portion 220 can be moved in a Z-direction. The first projecting portion 220 projects in a positive Z-direction. Here, the Z-direction represents the up-down direction perpendicular to both of the front-rear direction and the pitch direction. Moreover, the positive Z-direction is directed upward while a negative Z-direction is directed downward. Thus, the first projecting portion 220 of the present embodiment projects upward and is movable in the up-down direction.

The first opposed supporting portion 230 mainly extends long in the front-rear direction and faces the first supporting portion 210 in the up-down direction. The first opposed supporting portion 230 is elastically deformable and supports the first opposed projecting portion 240. Owing to elastic deformation and movement of the first opposed supporting portion 230, the first opposed projecting portion 240 can be moved in the up-down direction. The first opposed projecting portion 240 projects downward and faces the first projecting portion 220 in the up-down direction. In the present embodiment, the first projecting portion 220 and the first opposed projecting portion 240 are positioned at positions same as each other in the front-rear direction.

The first coupling portion 250 couples the first supporting portion 210 with the first opposed supporting portion 230. The first operated portion 260 consists of two regions. The two regions of the first operated portion 260 are positioned apart from each other in the up-down direction and extend rearward from the first coupling portion 250 each. The first fixed portion 270 further extends rearward from one of the regions of the first operated portion 260. When the connector 10 is mounted on a circuit board (not shown), the first fixed portion 270 is a region to be fixed to the circuit board.

As shown in FIGS. 2, 5, 9 and 12, the second contact 300 has a base portion 310, a second supporting portion 320, a second projecting portion 330, a second opposed supporting portion 340, a second opposed projecting portion 350, a second coupling portion 360, a second operated portion 370 and a second fixed portion 380.

Figure 5:
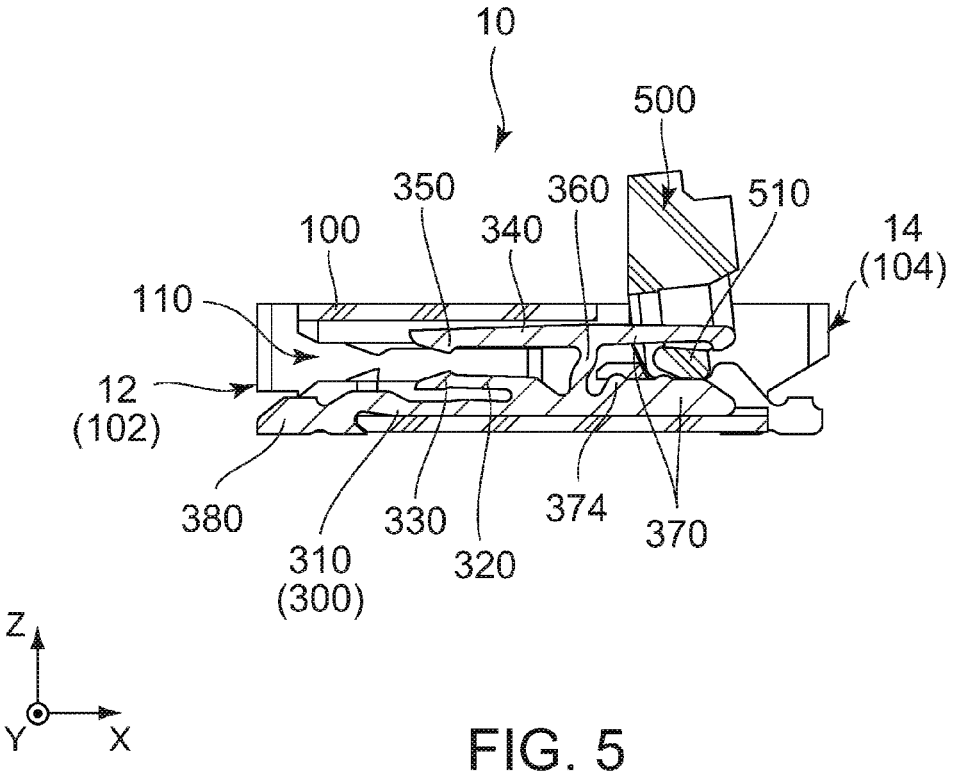
FIG. 5 is a cross-sectional view showing the connector of FIG. 3, taken along B-B line.
Figure 9:
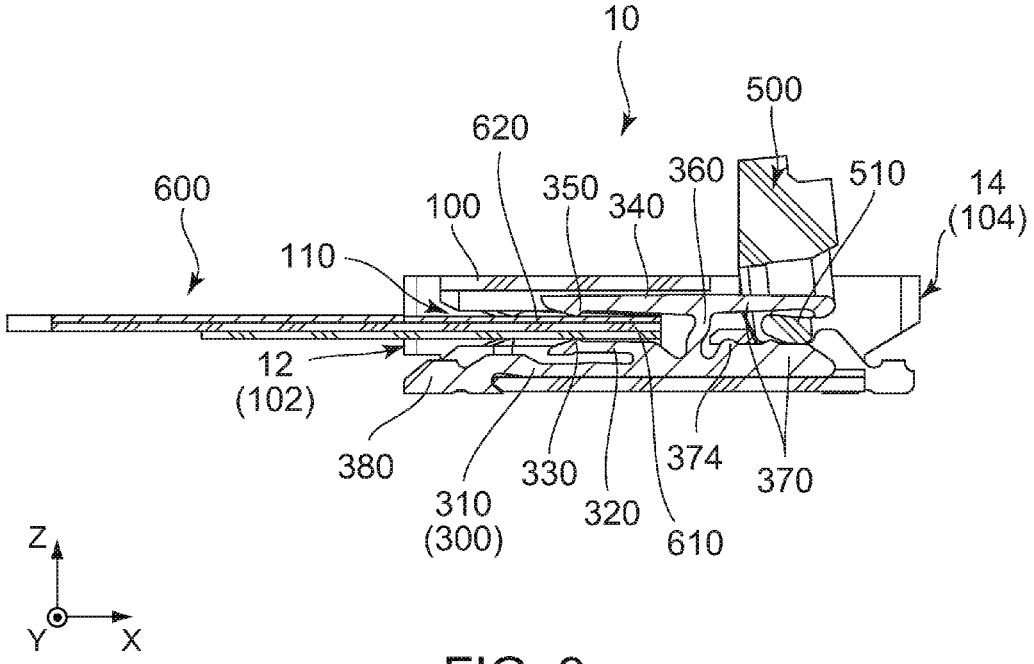
FIG. 9 is a cross-sectional view showing the connector of FIG. 7, wherein illustrated cross-sections correspond to the cross-sections of FIG. 5.
Figure 12:
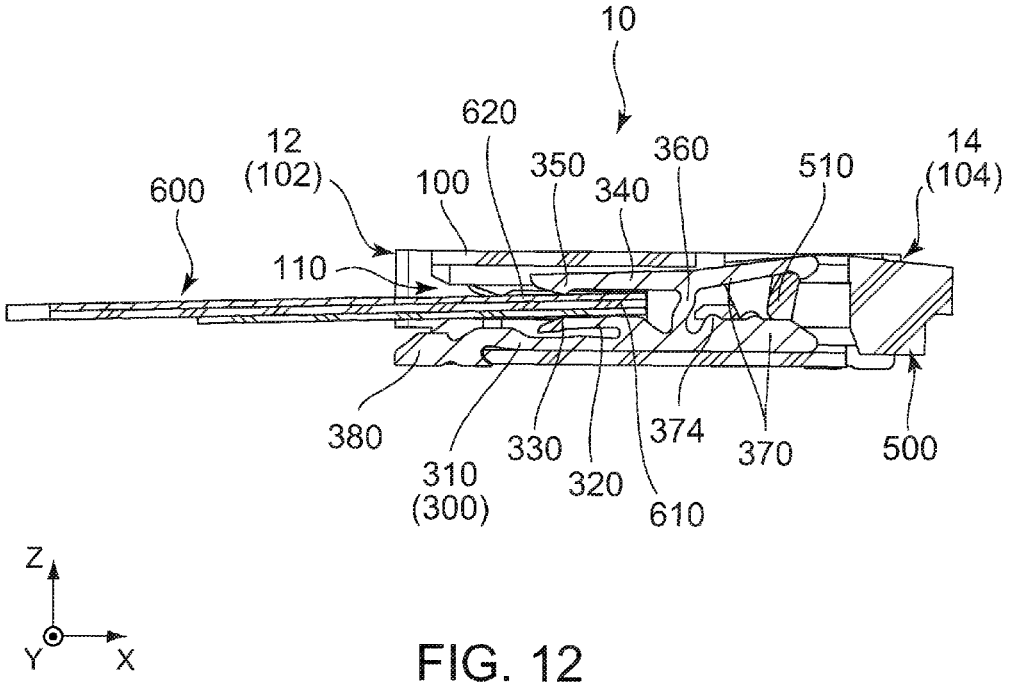
FIG. 12 is a cross-sectional view showing the connector of FIG. 9. The actuator of the illustrated connector is positioned at the close position.

As shown in FIGS. 5, 9 and 12, the base portion 310 mainly extends long in the front-rear direction. The second supporting portion 320 branches from the base portion 310 and mainly extends in the front-rear direction. The second supporting portion 320 is elastically deformable and supports the second projecting portion 330. Owing to elastic deformation and movement of the second supporting portion 320, the second projecting portion 330 can be movable in the up-down direction. The second projecting portion 330 projects upward.

The second opposed supporting portion 340 mainly extends long in the front-rear direction and faces the second supporting portion 320 in the up-down direction. The second opposed supporting portion 340 is elastically deformable and supports the second opposed projecting portion 350. Owing to elastic deformation and movement of the second opposed supporting portion 340, the second opposed projecting portion 350 can be moved in the up-down direction. The second opposed projecting portion 350 projects downward and faces the second projecting portion 330 in the up-down direction. In the present embodiment, the second projecting portion 330 and the second opposed projecting portion 350 are positioned at positions same as each other in the front-rear direction.

The second coupling portion 360 couples the base portion 310 with the second opposed supporting portion 340. The second operated portion 370 consists of two regions. The two regions of the second operated portion 370 are positioned apart from each other in the up-down direction and extend rearward from the second coupling portion 360 each. One of the regions of the second operated portion 370 is provided with a second press-fit portion 374. The second fixed portion 380 extends forward from the base portion 310. When the connector 10 is mounted on the circuit board (not shown), the second fixed portion 380 is a region to be fixed to the circuit board.

As shown in FIG. 2, the maintaining member 400 has a shape same as the first contact 200. As shown in FIGS. 2, 6, 10 and 13, the maintaining member 400 has a third supporting portion (a supporting portion) 410, a third projecting portion (a projecting portion) 420, a third opposed supporting portion 430, a third opposed projecting portion 440, a third coupling portion 450, a third operated portion 460 and a third fixed portion 470.

Figure 6:
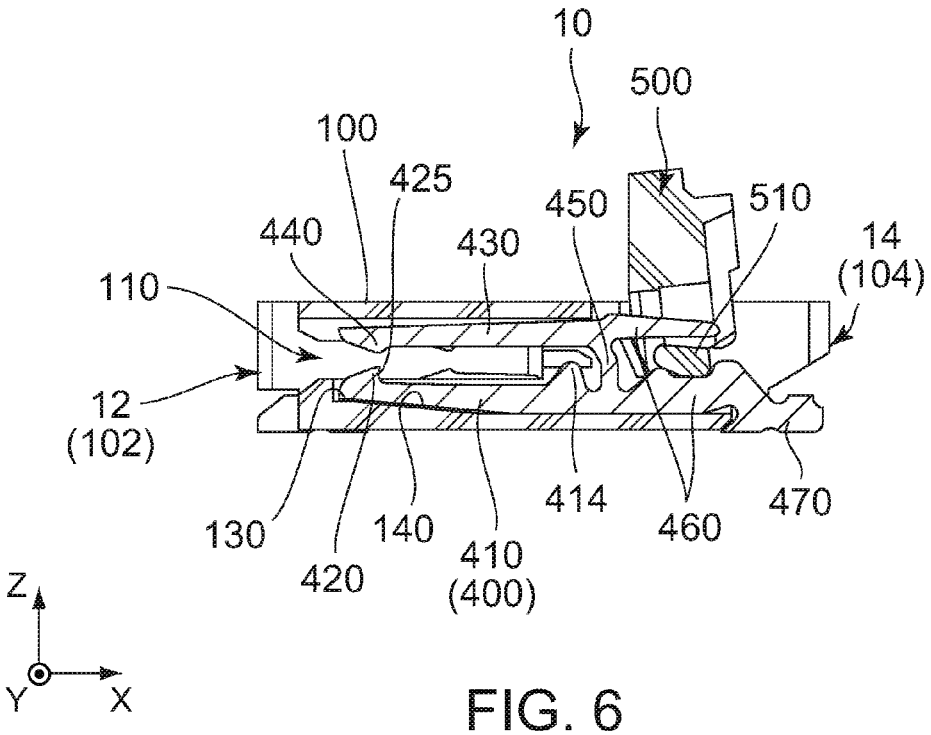
FIG. 6 is a cross-sectional view showing the connector of FIG. 3, taken along C-C line.
Figure 10:
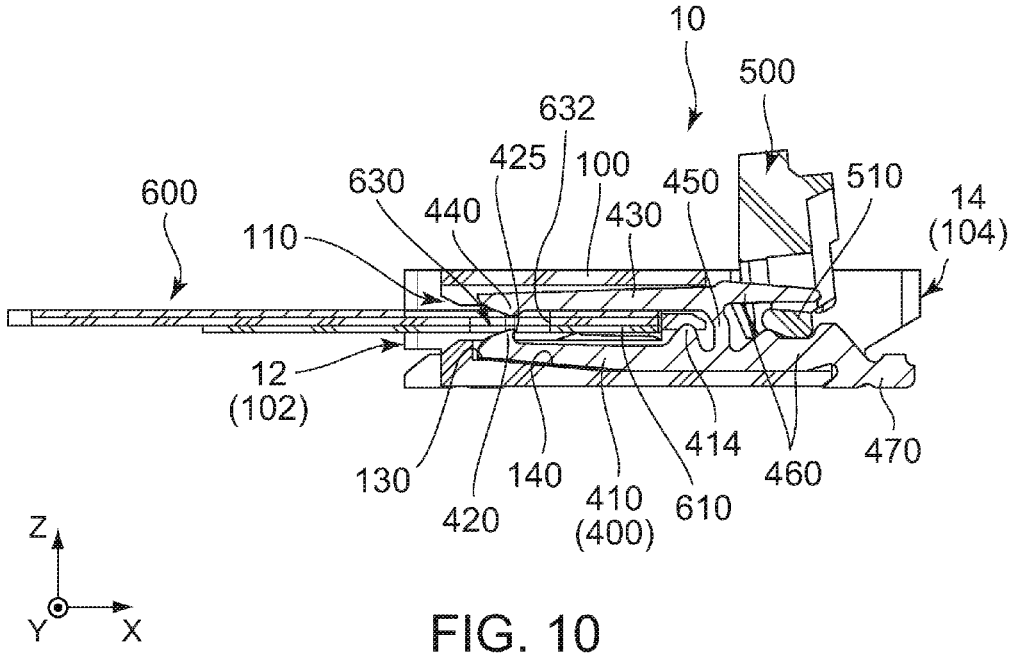
FIG. 10 is a cross-sectional view showing the connector of FIG. 7, wherein illustrated cross-sections correspond to the cross-sections of FIG. 6.
Figure 13:
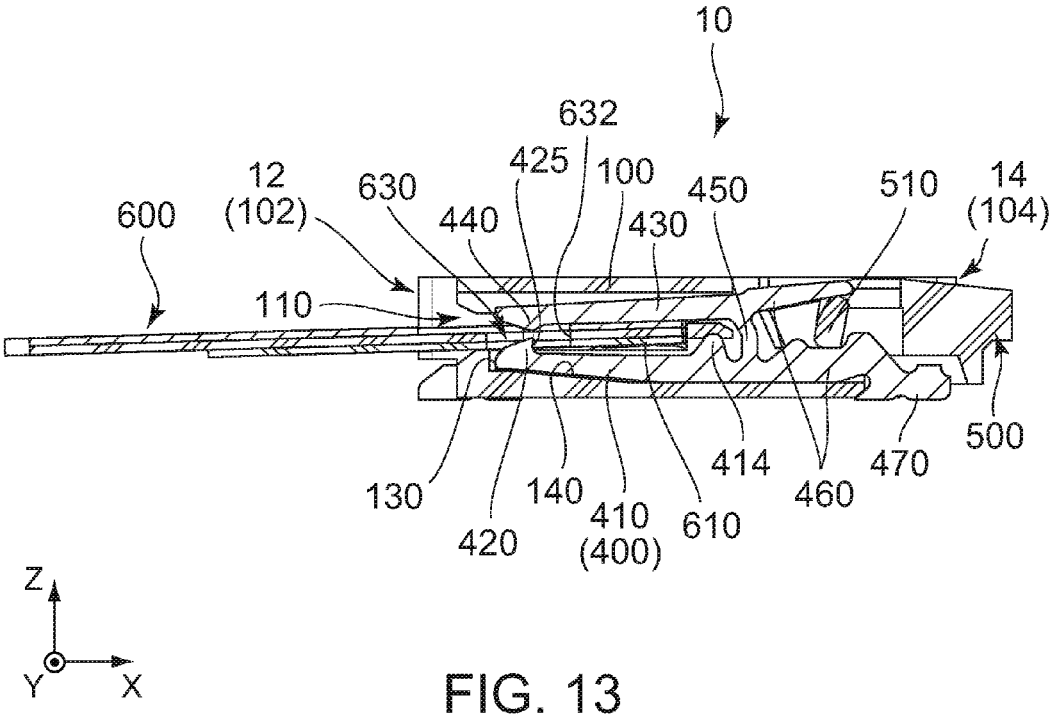
FIG. 13 is a cross-sectional view showing the connector of FIG. 10. The actuator of the illustrated connector is positioned at the close position.

As shown in FIGS. 6, 10 and 13, the third supporting portion 410 mainly extends long in the front-rear direction. The third supporting portion 410 is provided with a third press-fit portion 414. The third supporting portion 410 is elastically deformable and supports the third projecting portion 420. The third projecting portion 420 projects upward.

The third projecting portion 420 of the maintaining portion 400 is provided with an engaging portion 425. The engaging portion 425 is a rear edge of the third projecting portion 420 and extends rearward diagonally to an inside of a receiving portion 110. The engaging portion 425 and a virtual line segment extending rearward from a base of the engaging portion 425 in parallel with the front-rear direction forms an angle smaller than 90 degrees. It should be noted that, though the first contact 200 of FIG. 4 has a region corresponding to the engaging portion 425 of FIG. 6, nothing is mentioned using a reference numerals in the aforementioned description regarding the first contact 200.

The third opposed supporting portion 430 mainly extends long in the front-rear direction and faces the third supporting portion 410 in the up-down direction. The third opposed supporting portion 430 is elastically deformable and supports the third opposed projecting portion 440. Owing to elastic deformation and movement of the third opposed supporting portion 430, the third opposed projecting portion 440 can be moved in the up-down direction. The third opposed projecting portion 440 projects downward and faces the third projecting portion 420 in the up-down direction. In the present embodiment, the third projecting portion 420 and the third opposed projecting portion 440 are positioned at positions same as each other in the front-rear direction.

The third coupling portion 450 couples the third supporting portion 410 with the third opposed supporting portion 430. The third operated portion 460 consists of two regions. The two regions of the third operated portion 460 are positioned apart from each other in the up-down direction and extend rearward from the third coupling portion 450 each. The third fixed portion 470 further extends from lower one of the regions of the third operated portion 460. Thus, the third supporting portion 410 and the third fixed portion 470 are a lower region of the maintaining member 400 and located near each other in the up-down direction. When the connector 10 is mounted on the circuit board (not shown), the third fixed portion 470 is a region to be fixed to the circuit board. When the third fixed portion 470 is fixed to the circuit board, it is strengthened to regulate movement of the third supporting portion 410 and the third projecting portion 420 in the front-rear direction.

As understood from FIGS. 1 to 6, the housing 100 holds the first contacts 200, the second contacts 300 and the maintaining members 400. Specifically, by inserting the first contacts 200 and the maintaining members 400 into the housing 100 forward from a rear end 104 of the housing 100 and engaging the first press-fit portions 214 and the third press-fit portions 414 in the housing 100, the first contacts 200 and the maintaining members 400 are held by the housing 100. Moreover, by inserting the second contacts 300 into the housing 100 rearward from a front end 102 of the housing 100 and engaging the second press-fit portions 374 in the housing 100, the second contacts 300 are held by the housing 100.

As shown in FIGS. 2 to 6, in the housing 100 are formed the receiving portion 110, permitting portions 120, regulating portions 130 and press-fit guide portions 140. That is, in the present embodiment, the regulating portions 130 are formed from portions of the housing 100. However, the present invention is not limited thereto. A portion of metal pieces embedded in the housing 100 or a portion of hold-downs attached to the housing 100 may be used as a regulating portion.

As shown in FIGS. 8 to 10, the receiving portion 110 is a space for receiving the object 600 in part along the front-rear direction. As shown in FIGS. 4 to 6, the receiving portion 110 is opened at the front end 102 of the housing 100 and leads to the rear end 104 via spaces for accommodating the first contacts 200.

As shown in FIGS. 4, 8 and 11, the permitting portion 120 is the space provided to correspond to the first contact 200 and communicates with the receiving portion 110 in the up-down direction. Owing to existence of the permitting portion 120, the first supporting portion 210 of the first contact 200 can be elastically deformed and moved. In other words, the permitting portion 120 allows the first supporting portion 210 of the first contact 200 to be elastically deformed and moved. Consequently, the first projecting portion 220 can be moved in the up-down direction. Specifically, in the present embodiment, since the permitting portion 120 is provided in the housing 100, the first projecting portion 220 can be moved downward in the receiving portion 110. Especially, as shown in FIG. 11, in the present embodiment, even in a case where the first projecting portion 220 is moved downward in the receiving portion 110, a depth (a size in the up-down direction) of the permitting portion 120 is set so that the supporting portion 210 and the first projecting 220 of the first contact 200 do not reach a bottom of the permitting portion 120.

As shown in FIG. 6, the regulating portion 130 and the press-fit guide portion 140 are provided to correspond to the maintaining member 400.

The regulating portion 130 is positioned under the third projecting portion 420 to receive the third projecting portion 420. Owing to existence of the regulating portion 130, the third supporting portion 410 of the maintaining member 400 cannot be elastically deformed or moved. In other words, the regulating portion 130 regulates elastic deformation and movement of the third supporting portion 410 of the maintaining member 400. Consequently, the third projecting portion 420 cannot be moved in the up-down direction. Specifically, in the present embodiment, since the regulating portion 130 is provided, the third projecting portion 420 cannot be moved downward in the receiving portion 110. Accordingly, a state where the third projecting portion 420 projects into the receiving portion 110 in the up-down direction is maintained. The regulating portion 130 of the present embodiment is a plane (a horizontal plane) perpendicular to the up-down direction. However, the regulating portion 130 may not be perpendicular to the up-down direction nor be a plane provided that the regulating portion 130 can regulate movement of the third projecting portion 420.

The regulating portion 130 of the present embodiment is positioned slightly apart from the maintaining member 400. However, the regulating portion 130 may be in contact with the maintaining member 400 or keep further away from the maintaining member 400 provided that the regulating portion 130 can regulate movement of the third projecting portion 420.

The press-fit guide portion 140 is positioned behind the regulating portion 130 in the front-rear direction. The press-fit guide portion 140 guides the maintaining member 400 so that the third projecting portion 420 of the maintaining member 400 projects into the receiving portion 110 when the maintaining member 400 is press-fitted into the housing 100 forward from the rear end 104 of the housing 100. Owing to the guiding, it is possible to prevent shavings from being generated in the housing 100.

The press-fit guide portion 140 of the present embodiment is an inclined plane intersecting with both of the front-rear direction and the up-down direction. However, the press-fit guide portion 140 may not be the inclined plane provided that the press-fit guide portion 140 can guide for press-fitting appropriately.

As understood from FIGS. 1 and 4 to 6, the actuator 500 is accommodated in part at a vicinity of the rear end 104 of the housing 100. As shown in FIGS. 4 to 6, the actuator 500 is supported by the first contact 200, the second contact 300 and the maintaining member 400 to be rotationally movable between an open position and a close position. Herein the open position of the actuator 500 is a position shown in FIGS. 1, 3 to 10 while the close position of the actuator 500 is a position shown in FIGS. 11 to 13.

Specifically, as shown in FIG. 2, the actuator 500 is provided with a plurality of cam portions 510. As shown in FIGS. 4 to 6, by inserting each of the cam portions 510 into any one of the first operated portions 260, the second operated portions 370 and the third operated portions 460, the actuator 500 is supported by the first contacts 200, the second contacts 300 and the maintaining members 400.

As shown in FIG. 11, when the actuator 500 is moved from the open position to the close position, the first operated portion 260 is opened by the cam portion 510 and, thereby, elastically deforms the first contact 200 to bring the first projecting portion 220 and the first opposed projecting portion 240 near to each other. Referring to FIGS. 12 and 13, by the movement of the actuator 500, the second contact 300 and the maintaining member 400 are applied with similar force.

As understood from FIGS. 4 to 6 and 8 to 13, the connector 10 of the present embodiment is a so called back flip type that the actuator 500 positioned at the open position is turned rearward to move the actuator 500 to the close position. However, the present invention is not limited thereto but applicable to a front flip type for example.

As shown in FIG. 10, in the connector 10 having aforementioned structure, the third projecting portion 420 of the maintaining member 400 is positioned in front of the engaged portion 632 of the object 600 in a received state where the object 600 is received by the receiving portion 110 in part.

As understood from FIGS. 8 and 11, when the actuator 500 is moved from the open position to the close position in the received sate, the first projecting portion 220 and the first opposed projecting portion 240 of the first contact 200 are pressed against the object 600. Similarly, as understood from FIGS. 9 and 12, the second projecting portion 330 and the second opposed projecting portion 350 of the second contact 300 are also pressed against the object 600. Therefore, in the present embodiment, when the object 600 is inserted into the connector 10 normally, the first projecting portion 220 and the second projecting portion 330 are connected to the terminals 620 of the object 600. On the other hand, when the object 600 is inverted upside down and inserted into the connector 10, the first opposed projecting portion 240 and the second opposed projecting portion 350 are connected to the terminals 620 of the object 600. Thus, the connector 10 of the present embodiment is designed for so called reversible insertion.

Especially, as mentioned before, in the present embodiment, the first projecting portion 220 and the first opposed projecting portion 240 are positioned at the same position as each other in the front-rear direction while the second projecting portion 330 and the second opposed projecting portion 350 are positioned at the same position as each other in the front-rear direction. Accordingly, it is possible to equalize an effective contact length in a case of inserting the object 600 upside down to that in a case of inserting the object 600 normally.

As shown in FIG. 11, when the actuator 500 is positioned at the close position in the received state, the object 600 is sandwiched between the first projecting portion 220 and the first opposed projecting portion 240 of the first contact 200. Similarly, as shown in FIG. 12, the object 600 is sandwiched between the second projecting portion 330 and the second opposed projecting portion 350 of the second contact 300.

Figure 14:
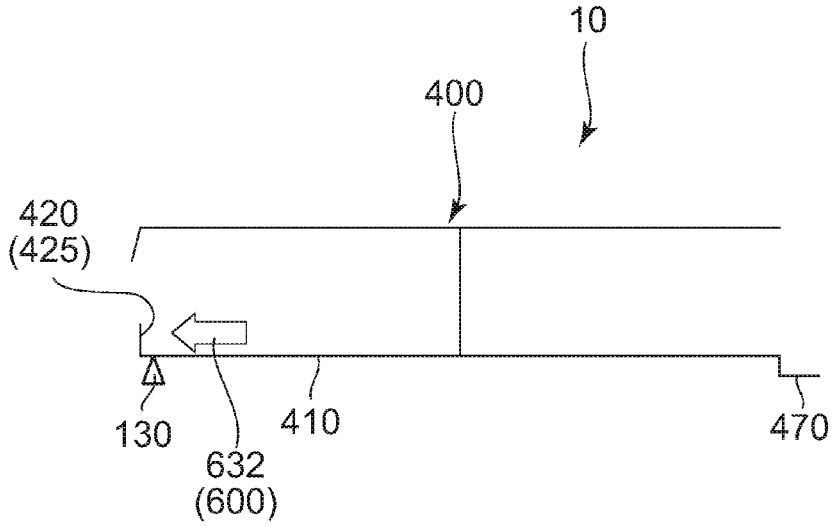
FIG. 14 is a schematic view used for description of advantage of the connector of FIG. 13.
Figure 15:
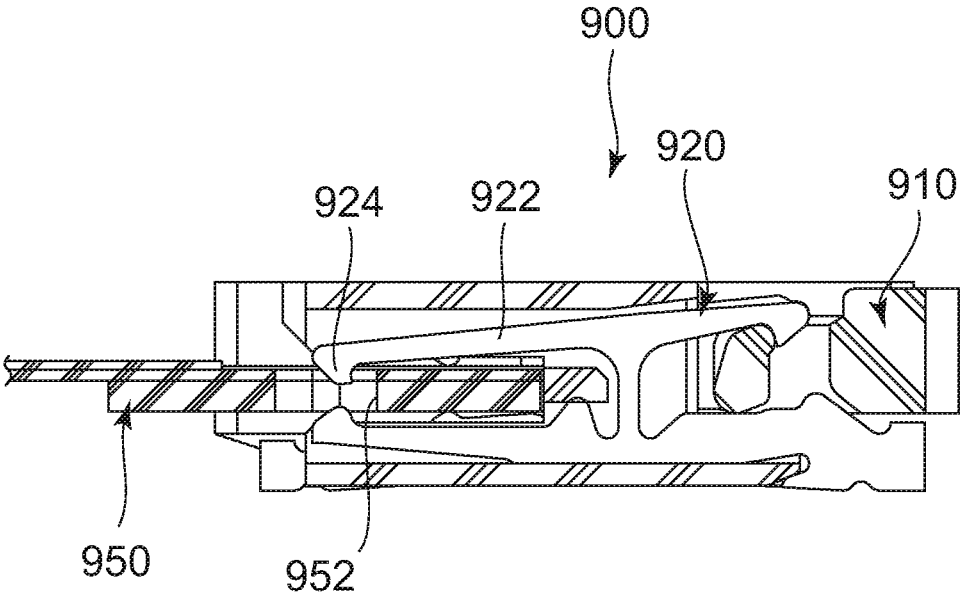
FIG. 15 PRIOR ART
FIG. 15 is a cross-sectional view showing a connector of Patent Document 1.

As shown in FIG. 13, when the actuator 500 is positioned at the close position in the received state, the engaging portion 425 of the maintaining member 400 faces the engaged portion 632 of the object 600 in the front-rear direction. At this time, the regulating portion 130 receives the third projecting portion 420 and, thereby, suppresses elastic deformation of the third supporting portion 410 of the maintaining member 400 that is elastically deformable essentially. Therefore, the third projecting portion 420 is regulated not to be moved downward, and the state where the engaging portion 425 faces the engaged portion 632 in the front-rear direction is maintained certainly. Specifically, as understood from FIG. 14, since the regulating portion 130 regulates downward movement of the third projecting portion 420, the object 600 does not come off even though the engaged portion 632 of the object 600 is brought into abutment with the engaging portion 425 of the third projecting portion 420. Furthermore, since the third fixed portion 470 is fixed to the circuit board (not shown), regulation for forward movement of the third projecting portion 420 is strengthened. Accordingly, the maintaining member 400 is not deformed and it is realized to prevent the object 600 from coming off. Referring to FIG. 13, in the present embodiment, when the actuator 500 is positioned at the close position in the received state, the third supporting portion 410 and the third projecting portion 420 of the maintaining member 400 are not in contact with the object 600.

Though the embodiments of the present invention are mentioned above, the present invention is not limited thereto.

As described above, the maintaining member 400 of the present embodiment has the same shape as the first contact 200. However, the present invention is not limited thereto. For example, provided that the first supporting portion 210 and the first projecting portion 220 of the first contact 200 have the same shapes as the third supporting portion 410 and the third projecting portion 420 of the maintaining member 400, respectively, other portions may be different in shape from each other.

In the aforementioned embodiment, the first supporting portion 210 is positioned at a lower side of the connector 10 while the first opposed supporting portion 230 is positioned at an upper side of the connector 10. However, the present invention is not limited thereto. The first supporting portion 210 is positioned at the upper side of the connector 10 while the first opposed supporting portion 230 is positioned at the lower side of the connector 10.

In the aforementioned embodiment, by fixing the third fixed portion 470 on the circuit board (not shown), the regulation for movement of the third supporting portion 410 and the third projecting portion 420 in the front-rear direction is strengthened. However the present invention is not limited thereto. A region for regulating movement of the third projecting portion 420 in the front-rear direction may be provided to the housing 100.

In the aforementioned embodiment, when the actuator 500 is positioned at the open position, the third operated portion 460 of the maintaining member 400 is not applied with a load. However, in a case of making the connector 10 have provisional holding function to hold the object 600 provisionally, an interval between the third projecting portion 420 and the third opposed projecting portion 440 may be reduced by applying a load on the third operated portion 460 by means of the cam portion 510 even though the actuator 500 is positioned at the open position.

The present application is based on a Japanese patent application of JP2015-012387 filed before the Japan Patent Office on Jan. 26, 2015, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which allows a sheet-like or plate-like object to be inserted toward a rear end of the connector from a front end of the connector in a front-rear direction, the object having an engaged portion, wherein:

the connector comprises a contact, a maintaining member, a housing, a regulating portion, and an actuator;

each of the contact and the maintaining member has a supporting portion which is elastically deformable and a projecting portion which is supported by the supporting portion;

the supporting portion and the projecting portion of the contact have shapes same as shapes of the supporting portion and the projecting portion of the maintaining member, respectively;

the housing holds the contact and the maintaining member;

the housing is provided with a receiving portion, which receives the object when the object is inserted into the connector, and a permitting portion corresponding to the contact;

the permitting portion permits elastic deformation and movement of the supporting portion of the contact to allow the projecting portion of the contact to be moved in an up-down direction perpendicular to the front-rear direction;

the regulating portion is provided in the housing to receive the projecting portion of the maintaining member, and thereby regulates elastic deformation and movement of the supporting portion of the maintaining member so as to maintain a state in which the projecting portion of the maintaining member projects into the receiving portion in the up-down direction;

the actuator is movable between an open position and a close position;

when the actuator is moved from the open position to the close position in a received state in which the object is received by the receiving portion in part, the projecting portion of the contact is pressed against the object; and when the actuator is positioned at the close position in the received state, the projecting portion of the maintaining member is positioned in front of the engaged portion of the object.

2. The connector as recited in claim 1, wherein the regulating portion is formed from a part of the housing.

3. The connector as recited in claim 1, wherein the maintaining member has a shape same as a shape of the contact.

4. The connector as recited in claim 1, wherein:

the contact has an opposed supporting portion and an opposed projecting portion;

the opposed supporting portion faces the supporting portion of the contact in the up-down direction;

the opposed projecting portion is supported by the opposed supporting portion and faces the projecting portion of the contact in the up-down direction; and when the actuator is positioned at the close position in the received state, the object is sandwiched between the projecting portion of the contact and the opposed projecting portion of the contact.

5. The connector as recited in claim 4, wherein the projecting portion and the opposed projecting portion are positioned at positions same as each other in the front-rear direction.

6. The connector as recited in claim 1, wherein:

the projecting portion of the maintaining member is provided with an engaging portion extending obliquely rearward to an inside of the receiving portion; and when the actuator is positioned at the close position in the received state, the engaging portion of the maintaining member faces the engaged portion of the object in the front-rear direction.

7. The connector as recited in claim 1, wherein:

the housing is provided with a press-fit guide portion; and the press-fit guide portion is positioned behind the regulating portion and intersects with both of the front-rear direction and the up-down direction to guide the maintaining member so that the projecting portion of the maintaining member projects into the receiving portion when the maintaining member is press-fit forward from a rear end of the housing.

8. The connector as recited in claim 1, wherein the actuator is moved to the close position by turning the actuator positioned at the open position rearward.

* * * * *